US007950188B1

(12) United States Patent
Galbraith et al.

(10) Patent No.: US 7,950,188 B1
(45) Date of Patent: May 31, 2011

(54) GUTTER PROTECTOR

(75) Inventors: C. John Galbraith, Media, PA (US); Kenneth Overk, Deptford, NJ (US); Chiu Y. Chan, Wilmington, DE (US)

(73) Assignee: Foamex Innovations Operating Company, Media, PA (US)

( * ) Notice: Subject to any disclaimer, the term of this patent is extended or adjusted under 35 U.S.C. 154(b) by 28 days.

(21) Appl. No.: 12/137,625

(22) Filed: Jun. 12, 2008

Related U.S. Application Data

(60) Provisional application No. 60/943,751, filed on Jun. 13, 2007, provisional application No. 60/945,654, filed on Jun. 22, 2007.

(51) Int. Cl.
*E04D 13/00* (2006.01)

(52) U.S. Cl. ..... 52/12; 52/11

(58) Field of Classification Search ..... 52/12, 11; 210/162; D23/209
See application file for complete search history.

(56) References Cited

U.S. PATENT DOCUMENTS

| | | | | | |
|---|---|---|---|---|---|
| D122,817 | S | * | 10/1940 | Ford | D23/209 |
| 3,258,205 | A | * | 6/1966 | Hruby, Jr. | 239/204 |
| 3,855,132 | A | * | 12/1974 | Dugan | 210/455 |
| 4,265,963 | A | | 5/1981 | Matalon | |
| 4,826,882 | A | | 5/1989 | Bredbenner et al. | |
| 4,949,514 | A | * | 8/1990 | Weller | 52/12 |
| 5,107,635 | A | * | 4/1992 | Carpenter | 52/12 |
| 5,242,591 | A | * | 9/1993 | Beechert et al. | 210/474 |
| 5,536,406 | A | * | 7/1996 | Silva | 210/460 |
| 5,595,027 | A | * | 1/1997 | Vail | 52/12 |
| 5,721,281 | A | | 2/1998 | Blount | |
| RE36,343 | E | * | 10/1999 | Silva | 210/460 |
| 6,134,843 | A | * | 10/2000 | Tregear | 52/12 |
| 6,223,474 | B1 | * | 5/2001 | Kafton | 52/12 |
| 6,442,912 | B1 | | 9/2002 | Phillips et al. | |
| 6,932,911 | B1 | * | 8/2005 | Groth et al. | 210/747 |
| 7,200,969 | B2 | * | 4/2007 | Rotter | 52/12 |
| 7,208,081 | B2 | * | 4/2007 | Jones | 210/162 |
| D550,804 | S | * | 9/2007 | Jones | D23/209 |
| 7,303,687 | B2 | * | 12/2007 | Groth et al. | 210/747 |
| 2002/0134029 | A1 | | 9/2002 | Groom | |
| 2004/0006927 | A1 | | 1/2004 | Wickett | |
| 2005/0034376 | A1 | * | 2/2005 | Pourdeyhimi et al. | 52/11 |
| 2005/0178072 | A1 | | 8/2005 | Olthoff | |
| 2006/0037253 | A1 | * | 2/2006 | Mozeika, III | 52/12 |
| 2006/0096189 | A1 | | 5/2006 | Pavlansky et al. | |
| 2006/0117672 | A1 | * | 6/2006 | Kurple et al. | 52/12 |
| 2006/0278573 | A1 | * | 12/2006 | Robinson | 210/460 |
| 2010/0170837 | A1 | * | 7/2010 | Konkey | 210/162 |

FOREIGN PATENT DOCUMENTS

| | | | | |
|---|---|---|---|---|
| CH | 661312 | | | 7/1987 |
| DE | 10016447 | A1 | * | 10/2001 |
| JP | 06117065 | A | * | 4/1994 |
| JP | 2001152620 | A | * | 6/2001 |
| JP | 2008290396 | A | * | 12/2008 |

* cited by examiner

*Primary Examiner* — Robert J Canfield
*Assistant Examiner* — Charissa Ahmad
(74) *Attorney, Agent, or Firm* — Connolly Bove Lodge & Hutz LLP

(57) ABSTRACT

A gutter protector formed of a flexible open cell porous foam has at least one undulated bottom surface. The undulations of the bottom surface may be ridges defining generally parallel channels to direct water through the gutter passageway. Optionally, undulations may be provided on one side surface. Such undulations on the side surface may be ridges or other convolute cut projections that are compressible and help to secure the gutter protector under compression within the gutter passageway.

16 Claims, 1 Drawing Sheet

Fig.1.
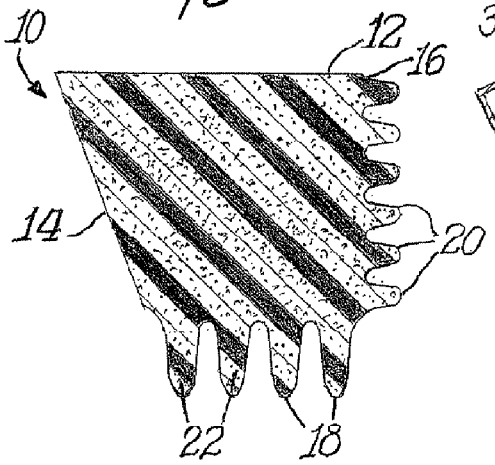
Fig.2.
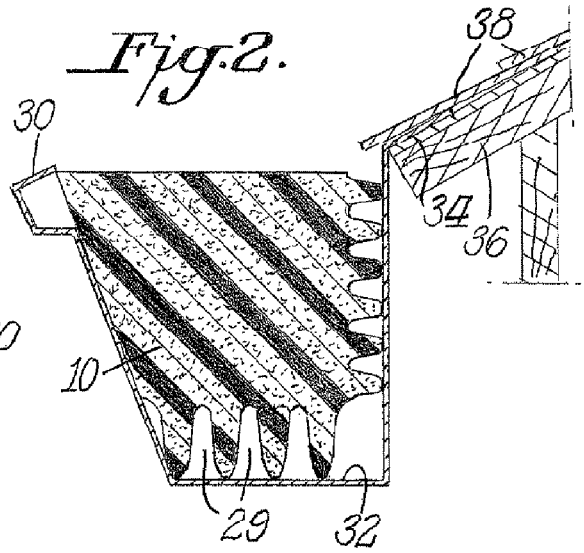
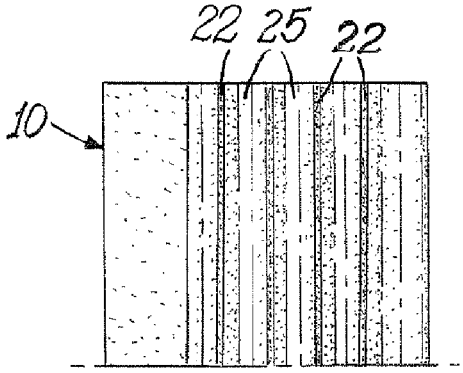
Fig.3.
Fig.4.
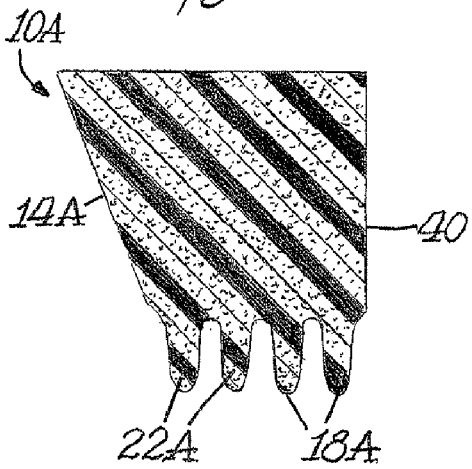

GUTTER PROTECTOR

CROSS-REFERENCE TO RELATED APPLICATIONS

This application claims the benefit of U.S. Provisional Application Nos. 60/943,751, filed Jun. 13, 2007 and 60/945,654, filed Jun. 22, 2007.

FIELD OF THE INVENTION

The present invention relates to rain gutters for houses or the like. More particularly, the present invention concerns a porous structure that is in inserted within a rain gutter to prevent the gutter from blocking or clogging with debris, such as leaves or other foreign materials.

BACKGROUND OF THE INVENTION

Rain gutters are commonly installed along the lower edges of a sloping roof under the eaves to catch water draining from the roof. Such gutters can become clogged with debris, such as leaves, twigs, seeds and pods, carried to the roof by wind or gravity and washed into the gutter. This debris fills and clogs the gutters and the gutter downspouts, causing water to overflow out of the gutters and over the eaves.

Many devices have been proposed to prevent gutters from clogging. One type of device mounts a screen or cover to the open, upper portion of the gutter. Such screens or covers are intended to permit water to flow through, while at the same time catching the debris. Unfortunately, over a period of time, the leaves and foreign matter collect on the devices and disrupt, divert or prevent water from flowing through the device into the gutter. Consequently, screen-type devices require periodic cleaning or maintenance to ensure proper operation.

Foam filters for gutter systems have been disclosed. U.S. Pat. No. 7,208,081 shows a gutter foam filter formed from columns of open-pore polyether foam, where the columns have a cross sectional shape of a truncated triangle. The columns are held within the gutter underneath a series of gutter spikes. Such foam must be cut to fit gutters of varying width.

U.S. Pat. No. 4,949,514 concerns a gutter liner formed from solid porous material, such as a reticulated porous polyurethane foam. A flat panel of the porous material is folded into an inverted "U"-shape to define a water channel between the two legs of the inverted "U". Undulations are formed on the top barrier surface. Ridges may be formed on the outer side surfaces of the liner to engage the side walls of the gutter. When installed within a gutter, such liner structure generally includes a spacer means to keep the side walls of the inverted "U"-shape separate from one another to define the water channel.

Improvements to foam gutter protectors continue to be sought.

SUMMARY OF THE INVENTION

In a first aspect, a gutter protector is formed form a flexible, elongated, open pore foam member having a generally flat top surface, a sloped side surface, an undulated side surface opposite to the sloped side surface and an undulated bottom surface. The undulated bottom surface has a series of ridges having a peak-to-valley ratio between about 1.1:1 and 4.0:1. The undulated side surface has a series of ridges having a peak-to-valley ratio between about 1.1:1 and 1.6:1. Preferably, the foam member is formed from a reticulated foam with a pore size or pore count of about 5 to 15 pores per inch and a density in the range of about 1.0 to 3.5 pounds per cubic foot. Liquid fire retardants, anti-microbial agents and UV inhibitors may be incorporated into or applied to the foam forming the gutter protector.

In a second aspect, an alternative gutter protector is formed from a flexible, elongated, open pore foam member having a generally flat top surface, a sloped side surface and an undulated bottom surface. The side surface opposite to the sloped side surface in this alternative embodiment is generally flat and generally perpendicular to the top surface.

In a third aspect, a gutter system comprises a gutter protector installed within a gutter passageway. When so installed, the undulated bottom surface of the gutter protector is in contact with a bottom inner surface of the passageway of said gutter, and the spaces between the undulations or ridges define channels for water or other liquid to flow through. When so installed, the undulated side surface of the first embodiment of the gutter protector has a series of ridges that are at least partially compressed when said foam member is installed within the passageway.

DESCRIPTION OF THE FIGURES

Numerous other objects, features and advantages of the invention shall become apparent upon reading the following detailed description taken in conjunction with the accompanying drawings, in which:

FIG. 1 is a side elevational view of a gutter protector according to the invention;

FIG. 2 is an end view of the gutter protector of FIG. 1 installed within a "K"-type gutter;

FIG. 3 is a bottom plan view of the gutter protector of FIG. 1; and

FIG. 4 is a side elevational view of an alternative gutter protector according to the invention.

DESCRIPTION OF THE PREFERRED EMBODIMENTS

With reference to the drawings in which like numerals designate similar elements, FIGS. 1 and 3 show a gutter protector 10 that is formed of a flexible open cell or porous polyurethane foam. The gutter protector 10 has a substantially flat top surface 12 and a sloped side surface 14. Opposite to the sloped side surface 14 is an undulated side surface 16. Opposite to the top surface 12 is an undulated bottom surface 18.

The undulated side surface 16 has a series of ridges 20 formed therein. The ridges 20 preferably have a peak to valley ratio in the range of 1.1:1 to 1.6:1. For example, the height of the peak as measured between the top of the peak and the valley between two adjacent peaks may be between 0.5 to 1.5 inches and the width of the gutter protector may be between 4 to 7 inches. The ridges 20 may be a series of spaced apart parallel ridges as shown in FIG. 1. Alternatively, the ridges on the undulated side surface 16 may be formed as convolute cut structures, sometimes referred to as "egg crate" convolute.

The undulated bottom surface 18 has a series of ridges 22 formed therein. The ridges 22 preferably have a high peak to valley ratio, such as between about 1.1:1 to 4.0:1. For example, the height of the peak as measured between the top of the peak 22 and the valley 25 between two adjacent peaks or ridges 22 may be between 0.5 to 2.5 inches and the height of the gutter protector from the top surface to the tip of the peak on the undulated bottom surface may be between 4 to 7 inches. The ridges 22 may be a series of spaced apart parallel ridges as shown in FIGS. 1 and 3. Such ridges 22 define channels 29 between the peaks 22 through which water may travel within a gutter passageway when the gutter protector 10 is installed within such gutter passageway.

The foam forming the gutter protector preferably is a flexible, open pore polyether polyurethane foam. Such foam may be reticulated to remove cell windows and increase the porosity and liquid permeability of such foam. Thermal or chemical reticulation methods may be used. Pore count or pore size of such foam is preferably between 5 to 15 pores per inch. Foam density is preferably between about 1.0 and 3.5 pounds per cubic foot, or between 1.4 to 3.5 pounds per cubic foot before any coating is applied. If a coating is applied, such coating may increase the density from 10% to 350%, or greater if desired.

Various additives may be incorporated into the foam-forming mixture. For example, one or more liquid fire retardants and anti-microbial additives may be included in situ when forming the foam. In addition, coatings may be applied to the formed foam. For example, one or more UV inhibitors, anti-microbial agents and/or liquid fire retardants may be applied to the foam.

Referring next to FIG. 2, the gutter protector 10 is installed within a gutter passageway to form the gutter system. The gutter 30 is installed in customary fashion to a roofing system. In FIG. 2, the gutter 30 has a gutter securing structure that is connected to sheathing 34 over a rafter 36. The gutter securing structure is then covered by roofing shingles 38.

The open pore foam permits water or other liquids that impinge on the top surface 12 to pass therethrough, while filtering or blocking debris, such as leaves or twigs, that may be carried by water along the roof. A portion of the undulated bottom surface 18 of the gutter protector 10 is generally in contact with the bottom inner surface 32 of the gutter passageway. Generally parallel water channels are defined between the ridges 22 of the bottom surface 18, such that water or other liquids filtered through the foam of the gutter protector 10 to the bottom of the gutter passageway can flow therethrough until reaching a gutter downspout (not shown).

The undulations or ridges 20 on the side surface 16 are compressed to some degree to help hold the gutter protector 10 within the gutter passageway. The width of the gutter protector as measured along the top surface 12 to from the front edge adjacent the sloped side surface 14 to the top of an undulation or ridge 20 extending outwardly from the undulated side surface 16 is greater than the width of the gutter opening. In this way, the foam forming the gutter protector 10 is under some compression when installed within the gutter passageway. This helps to engage the gutter protector within the gutter passageway.

Referring to FIG. 4, an alternative embodiment of the gutter protector 10A is configured similarly to the gutter protector 10 shown in FIG. 1. The undulated bottom surface 18A has a series of ridges 22A formed therein. The ridges 22A preferably have a high peak to valley ratio, such as between about 1.1:1 to 4.0:1. For example, the height of the peak as measured between the top of the peak and the valley between two adjacent peaks or ridges may be between 0.5 to 2.5 inches and the height of the gutter protector from the top surface to the tip of the peak on the undulated bottom surface may be between 4 to 7 inches. Different from the gutter protector 10 shown in FIG. 1, however, the alternative embodiment 10A has a smooth side surface 40 opposite to the sloped side surface 14A.

While preferred embodiments of the invention have been described and illustrated here, various changes, substitutions and modifications to the described embodiments will become apparent to those of ordinary skill in the art without thereby departing from the scope and spirit of the invention.

What is claimed is:

1. A gutter protector, comprising:

a flexible, open pore foam member having a length, a generally flat top surface, a generally flat side surface sloped at an acute angle to the top surface, an undulated side surface opposite from the sloped side surface and at a generally right angle to the top surface, said undulated side surface having a series of compressible ridges with each ridge terminating at a rounded tip and having a length that extends longitudinally along the length of the foam member, and an undulated bottom surface having a series of three or more ridges, with each ridge terminating at a rounded tip and having a length that extends longitudinally along the length of the foam member forming two or more longitudinal channels between the ridges.

2. The gutter protector of claim 1, wherein the undulated bottom surface has a series of ridges having a peak-to-valley ratio between about 1.1:1 and 4.0:1.

3. The gutter protector of claim 1, wherein the undulated side surface has a series of ridges having a peak-to-valley ratio between about 1.1:1 and 1.6:1.

4. The gutter protector of claim 1, wherein the foam member is formed from a reticulated foam.

5. The gutter protector of claim 1, wherein the foam member is formed from a foam that has a pore count of about 5 to 15 pores per inch.

6. The gutter protector of claim 1, wherein the foam member is formed from a foam that has a density in the range of about 1.0 to 3.5 pounds per cubic foot.

7. The gutter protector of claim 1, wherein the foam member is formed from a foam that has incorporated therein or thereon an anti-microbial agent and a liquid fire retardant.

8. A gutter system, comprising:

a gutter associated with a building roof system and having a front wall and a rear wall and a bottom wall defining a passageway; and a flexible, open pore foam member having a length, a generally flat top surface, a generally flat side surface sloped at an acute angle to the top surface, an undulated side surface opposite from the sloped side surface and at a generally right angle to the top surface, said undulated side surface having a series of compressible ridges terminating at rounded tips, and an undulated bottom surface having a series of three or more ridges, with each ridge having a length that extends longitudinally along the length of the foam member forming two or more longitudinal channels between the ridges, wherein such foam member is installed within the passageway of said gutter with said sloped side surface in substantially continuous abutment to the front wall of said gutter and the tips of said ridges of the undulated side surface in contact with the rear wall.

9. The gutter system of claim 8, wherein the series of ridges of the undulated side surface are at least partially compressed when said foam member is installed within the passageway.

10. The gutter system of claim 8, wherein the undulated bottom surface is installed so as to be in contact with a bottom inner surface of the passageway of said gutter.

11. The gutter system of claim 8, wherein the foam member is formed from a reticulated foam.

12. The gutter system of claim 8, wherein the foam member is formed from a foam that has a density in the range of about 1.0 to 3.5 pounds per cubic foot and a pore count in the range of about 5 to 15 pores per inch.

13. The gutter system of claim 8, wherein the foam member is formed from a foam that has incorporated therein or thereon an anti-microbial agent and a liquid fire retardant.

14. The gutter system of claim 8, wherein the ridges of the undulated bottom surface terminate at rounded tips.

15. The gutter system of claim 14, wherein the rounded tips of the ridges of the undulated bottom surface contact the bottom wall of the passageway.

16. The gutter system of claim of claim 8, wherein the undulated bottom surface extends across substantially the whole bottom wall of the passageway.

* * * * *